US009185959B2

(12) United States Patent
Pires et al.

(10) Patent No.: US 9,185,959 B2
(45) Date of Patent: Nov. 17, 2015

(54) LIQUID APPLICATOR

(71) Applicant: Zen Design Solutions Limited, Tsim Sha Tsui, Kowloon (HK)

(72) Inventors: Leo Clifford Pires, Basking Ridge, NJ (US); Roger Hwang, Maple (CA); Rahul Bose, New Delhi (IN); Rajesh Deswal, Rohtak (IN)

(73) Assignee: ZEN DESIGN SOLUTIONS LIMITED, Kowloon, Hong Kong (CN)

( * ) Notice: Subject to any disclaimer, the term of this patent is extended or adjusted under 35 U.S.C. 154(b) by 256 days.

(21) Appl. No.: 14/053,468

(22) Filed: Oct. 14, 2013

(65) Prior Publication Data

US 2015/0104236 A1 Apr. 16, 2015

(51) Int. Cl.
*B43K 5/00* (2006.01)
*A45D 34/04* (2006.01)

(52) U.S. Cl.
CPC ..... *A45D 34/042* (2013.01)

(58) Field of Classification Search
CPC ..... A45D 34/042
USPC ..... 401/202, 205, 206, 278
See application file for complete search history.

(56) References Cited

U.S. PATENT DOCUMENTS

| | | | | |
|---|---|---|---|---|
| 3,400,997 | A | 9/1968 | Schwartzman | |
| 6,547,471 | B1 * | 4/2003 | Tucker | B65D 47/42 401/183 |
| 7,086,799 | B1 * | 8/2006 | Pappageorge | B43K 8/024 401/205 |
| 7,419,323 | B1 * | 9/2008 | Zhang | A45D 34/042 401/183 |
| 7,594,775 | B1 * | 9/2009 | Yoo | A45D 34/042 401/202 |
| 7,722,277 | B2 * | 5/2010 | Byun | A45D 34/04 401/202 |
| 7,931,417 | B2 * | 4/2011 | Yamamoto | B41K 1/08 401/198 |
| 8,123,426 | B2 * | 2/2012 | Byun | B65D 35/36 401/202 |

* cited by examiner

*Primary Examiner* — Jennifer C Chiang
(74) *Attorney, Agent, or Firm* — Patterson & Sheridan, LLP

(57) ABSTRACT

A liquid applicator comprising a container, a plug, a flow control unit, a biasing member, a collar holder, a discharge barrel, a collar, an application member, a cap and optionally a jacket. The cap or the jacket is configured to displace the collar holder along a longitudinal axis of the liquid applicator to bring the liquid applicator to an open position or to a closed position. The flow control unit closes the at least one aperture in the plug in the closed position; and in the open position, the flow control unit opens the at least one aperture in the plug and the liquid content flows from the at least one aperture to the collar holder so that the container, the plug and the collar holder are in fluid communication with each other.

20 Claims, 15 Drawing Sheets

LIQUID APPLICATOR

BACKGROUND

1. Field of the Invention

The present invention relates, in general, to a liquid applicator for cosmetics, chemicals or the like, and, more particularly, to a liquid applicator comprising a container, an application member and an actuation means, which when actuated enables a user to directly apply liquid content from the container onto a desired portion of user's skin.

2. Description of the Related Art

Generally, various kinds of cosmetics are available in the market. Recently, for the convenience of users, cosmetics are changing from solid cosmetics into liquid cosmetics. Furthermore, in order to allow a user to conveniently store and use the liquid cosmetics, various types of liquid applicators are being developed and used.

Further, various liquid applicators comprising containers for containing cosmetics, such as creams or lotions, which are applied to a user's body part, medicines such as ointments, and various kinds of liquid or liquid materials having viscosity, are being developed and used.

A container containing a liquid content having viscosity, generally uses a tube-type container which is made of soft synthetic resin or a pump-type container having pressurization pump. Such a container is used by squeezing a container body or spraying contents, because the liquid content having high viscosity is not smoothly discharged out of the container although the container is stood upside down or shaken.

However, the conventional tube-type or pump-type container is problematic in that, when a user desires to use the liquid content contained in the container, he or she must discharge the content through an outlet portion of the container and then apply the content onto his or her body part using the hand, so that it is inconvenient to wash off the content remaining on the hand after the liquid content has been applied to the body part.

U.S. Pat. No. 3,400,997 describes an applicator comprising a squeezable container having a cylindrical body, the cylindrical body includes a transverse web having an opening with a raised peripheral rib about the opening and forming a valve seat. A valve member is movable with respect to the valve seat and controls fluid flow through the opening. The valve member includes an applicator head above the web engageable with the rib to control fluid flow from the container to the head. A helical coil spring disposed entirely below the web is provided for urging the head away from the rib. A cap is provided which is threadedly engageable with the container and has a shoulder engageable with the head for forcing the head against the rib when the cap is closed.

U.S. Pat. No. 7,722,277 describes a tube type liquid container having an opening located at an upper portion, the opening being surrounded by a plurality of moving insert grooves; an upper body coupled to the tube type liquid container adjacent the opening; a solution transfer tube; a brush surrounding the solution transfer tube; an insert part provided at a lower portion of the upper body; an eject hole member having a divided opening and a sealing jaw ring located within the insert part; and a plurality of moving insert pieces provided at the lower portion of the upper body and engaging with the plurality of moving insert grooves. A check valve is located in an insert hole provided in the tube type liquid container, and a cap is threadedly coupled to the upper body.

Conventionally, the liquid applicator having a tube-type container comprises a biasing member which comes in contact with the liquid content as the liquid content flows from the tube container to an application member attached to the tube container. Since, the biasing member is generally made from a material including metal; there are chances of liquid content reacting with the material of the biasing member, resulting in contamination or deterioration of the liquid content. Therefore, there is a need in the art for a liquid applicator comprising a tube-type container in which the biasing member does not come in contact with the liquid content. Therefore, the liquid content is not deteriorated by the material of the biasing member.

SUMMARY

The present invention relates, in general, to a liquid applicator for cosmetics, chemicals or the like, and, more particularly, to a liquid applicator comprising a container, an application member and an actuation means which when actuated enables a user to directly apply liquid content from the container onto a desired portion of user's skin. Further, the liquid applicator of present invention prevents contamination of the liquid content from a biasing member of the liquid applicator.

According to an embodiment of the invention, the liquid applicator has a longitudinal axis and comprises a container, a plug, a flow control unit, a biasing member, a collar holder, a discharge barrel, a collar, an application member, an actuation means configured to displace the collar holder along the longitudinal axis to bring the liquid applicator to an open position or to a closed position.

According to a further embodiment of the invention, the container comprises a main body containing the liquid content and a mouth portion. The mouth portion comprises a barrel part, a rim and an opening in its central part. According to another embodiment of the invention, the container is a tube container or any other container with a main body which can be deformed by being pressed. According to another embodiment of the invention, the container comprises a main body which cannot be deformed by being pressed.

According to yet another embodiment of the invention, the plug is fitted into the mouth portion of the container, the flow control unit is arranged inside a hollow space of the plug, the biasing member such a spring is disposed inside the flow control unit, the collar holder is partially inside the plug and partially outside the plug, the discharge barrel is attached inside the collar holder, the collar is attached to the collar holder, the application member is attached to the collar and the actuation means is attached removably or irremovably to a portion of the container by suitable attachment means. The suitable attachment means includes a hinge, a pin, a snap, a hook, a j-lock, a threaded engagement, an interference engagement or the like.

According to yet another embodiment of the invention, the plug has a cylindrical shape having a peripheral wall fitted in the mouth portion of the container, a bottom wall formed with at least one aperture. According to a preferred embodiment, the bottom wall has a top surface and a bottom surface wherein the bottom surface has two apertures. The bottom wall further has an annular furrow. The bottom wall of the plug has a raised cylindrical post having an annular groove extended in a longitudinal direction providing a guide path for axial movement of the flow control unit inside the plug. Further, the plug has a radially extended circular rim which rests on a circular rim of the mouth portion of the container, and an annular projection on an inner side of the peripheral wall for interacting with the collar holder. The peripheral wall of the plug has at least one inwardly projected wall surface on its inner side which further guides the movement of the flow control unit in the longitudinal direction and prevents any translational movement of the flow control unit inside the plug. The at least one inwardly projected wall surface touches the top surface of the bottom wall. According to a preferred embodiment, the peripheral wall has two diametrically opposite inwardly projected wall surfaces on its inner side, wherein the two diametrically opposite inwardly projected wall surfaces touch the top surface of the bottom wall. The at least one inwardly projected wall surface results in the formation of a longitudinal furrow on the inner side of peripheral wall providing a path for the flow of the liquid content through the apertures. Preferably, the two diametrically opposite inwardly projected wall surfaces results in the formation of two longitudinal furrows on the inner side of the peripheral wall, providing a path for the flow of the liquid content through the apertures. A small amount of the liquid content can also flow along the inwardly projected wall surfaces.

According to yet another embodiment of the invention, the peripheral wall of the plug can be fitted in the mouth portion of the container by suitable attachment means. The suitable attachment means includes a hinge, a pin, a snap, a hook, a j-lock, a threaded engagement, an interference engagement or the like. According to a preferred embodiment of the invention, the peripheral wall of the plug has an annular projection on its outer side which engages with a corresponding annular groove on an inner side of the mouth portion of the container.

According to another embodiment of the invention, the flow control unit comprises a cavity formed by a hollow body having a top end and a bottom end. According to a further embodiment of the invention, the hollow body of the flow control unit comprises of a cylindrical wall portion, a conically tapered wall portion which tapers towards the top end and at least two flange discs on the cylindrical wall portion. The at least two flange discs are present on the cylindrical wall portion and below the tapered wall portion. According to a preferred embodiment of the invention, the at least two flange discs are present diametrically opposite to each other on the cylindrical wall portion and do not completely circumscribe the cylindrical wall portion of the flow control unit.

According to a further embodiment of the invention, the at least two flange discs are in close proximity with the peripheral wall of the plug. The flow control unit is capable of moving in an upward direction and a downward direction, inside the hollow space of the plug.

According to yet another embodiment of the invention, the flow control unit comprises a biasing member placed inside the cavity of the flow control unit, wherein the biasing member is enclosed within the cylindrical wall portion of the flow control unit and rests against a top surface of the cylindrical post on the bottom wall of the plug. The biasing member provides an upward moving force to the flow control unit. The biasing member can be a made up of metal, alloy or a thermoplastic polymer capable of providing resilient properties to the biasing member.

According to another embodiment of the invention, the collar holder comprises of a hollow cylindrical body having an open top end and an open bottom end. The collar holder comprises on its outer side, an annular flange at an appropriate position, an annular projection at the bottom end and an annular groove extended in a longitudinal direction up to a predetermined length. The collar holder is capable of moving in an upward direction and a downward direction in a predetermined interval depending upon the length of the annular groove. Further, the bottom end of the collar holder always rests on a flat surface of each of the two flange discs of the flow control unit.

According to another embodiment of the invention, the application member is attached to the collar by suitable attachment means. The suitable attachment means includes a hinge, a pin, a snap, a hook, a j-lock, a threaded engagement or the like. According to a preferred embodiment of the invention, the application member comprises an annular projection at a lower end which fits into a corresponding annular groove inside the collar.

According to yet another embodiment of the invention, the collar is attached to the collar holder by suitable attachment means. The suitable attachment means includes a hinge, a pin, a snap, a hook, a j-lock, a threaded engagement or the like. According to a further embodiment of the invention, the collar comprises an annular groove near a lower end of the collar which receives a corresponding annular projection at a top end of the collar holder.

According to yet another embodiment of the invention, the discharge barrel is attached inside the collar holder by suitable attachment means. The suitable attachment means includes a hinge, a pin, a snap, a hook, a j-lock, a threaded engagement or the like.

According to another embodiment of the invention, the liquid applicator comprises a cap as an actuation means for closing and opening of the liquid applicator. The cap is attached to a portion of the container by suitable attachment means. The suitable attachment means includes a hinge, a pin, a snap, a hook, a j-lock, a threaded engagement, an interference engagement or the like. Preferably, the cap is formed with threads adapted to be threadedly engaged with the threads on the mouth portion of the container. Further, the cap may comprise a sealing flange formed above the threads of the cap.

According to an embodiment of the invention, to bring the liquid applicator to the closed position the cap is displaced axially in a downward direction to displace the collar holder and the flow control unit axially in a downward direction along the longitudinal axis of the liquid applicator, counter to the upward biasing force of the biasing member. Preferably, the cap is screwed on to close the liquid applicator. As the cap is screwed on to bring the liquid applicator in a closed position, the sealing flange of the cap presses the annular flange of the collar holder so that the collar holder moves in a downward direction and the collar holder in turn pushes the flow control unit in a downward direction to close the apertures in the bottom wall of the plug. Simultaneously, the biasing member placed inside the cavity of the flow control unit is compressed. In the closed position, the annular flange at the predetermined position of the collar holder rests on the radially extended circular rim of the plug and a top end of the annular groove of the collar holder abuts against the annular projection on the inner side of the peripheral wall of the plug. In the closed position of the liquid applicator, the apertures in the bottom wall of the plug are completely blocked by the flow control unit and no liquid flows from the apertures even when the main body is under certain pressure.

According to an embodiment of the invention, to bring the liquid applicator to the open position, the cap is displaced axially in an upward direction so that the upward biasing force of the biasing member displaces the collar holder and the flow control unit axially in the upward direction along the longitudinal axis of the liquid applicator. Preferably, the cap is screwed off to bring the liquid applicator to an open position. As the cap is screwed off the biasing force of the biasing member pushes the flow control unit in an upward direction to open the apertures in the bottom wall of the plug and simultaneously the flow control unit pushes the collar holder so that the collar holder moves in an upward direction. In the open position, a bottom end of the annular groove of the collar holder abuts against the annular projection on the inner side of the peripheral wall of the plug and the inner side at the bottom end of the peripheral wall of the cylindrical portion of the flow control unit abuts against the radially extended circular rim of the post on the bottom wall of the plug. In the open position of the liquid applicator, the apertures in the bottom wall of the plug are completely open by the flow control unit and the liquid content flows from the apertures to the discharge barrel following a path through the plug and the collar holder such that the container, the plug and the collar holder are in fluid communication with each other. No liquid content enters into the flow control unit and the biasing member disposed inside the flow control unit does not come into contact with the liquid content. Thus, the liquid applicator prevents the liquid content from getting contaminated and also prevents wear of the biasing member, extending the life of the biasing member. Further, in the open position, when the main body is squeezed to force the liquid content out, no squeezed liquid content will backflow even when the pressure is reduced or stopped. Thus, the liquid applicator can not only be used conveniently but can isolate air pollution and, thus, has advantage in usage.

According to yet another embodiment of the present invention, the liquid applicator comprises a jacket as an actuation means for closing and opening of the liquid applicator. The liquid applicator also comprises a cap removably attached to the container so that application member remains housed and protected within the cap when not in use. The cap is attached to a portion of the container by suitable attachment means. The jacket is also attached to a portion of the container by suitable attachment means. The suitable attachment means includes a hinge, a pin, a snap, a hook, a j-lock, a threaded engagement, an interference engagement or the like. Preferably, the jacket is configured to be threadedly engaged with the barrel part of the mouth portion of the container and can be rotated and axially displaced about the barrel part of the mouth portion of the container between a closed position and an open position of the liquid applicator. Further, the jacket controls the axial displacement of the collar holder along the longitudinal axis of the liquid applicator. In order to bring the liquid applicator of present embodiment to the closed position, the jacket is displaced axially in a downward direction via rotation which in turn displaces the collar holder and the flow control unit axially in the downward direction along the longitudinal axis, counter to the upward biasing force of the biasing member disposed inside the flow control unit. More particularly, to bring liquid applicator to the closed position, the jacket is screwed on the barrel part of the mouth portion of the container such that the annular flange of the collar holder is pressed in a downward direction by a sealing flange of the jacket. The collar holder in turn pushes the flow control unit in a downward direction to close the apertures in the bottom wall of the plug and also simultaneously compresses the biasing member disposed inside the flow control unit.

To bring the liquid applicator to the open position, the cap is first removed from the container and the jacket is displaced axially in an upward direction via rotation of the jacket which allows the upward biasing force of the biasing member to displace the collar holder and the flow control unit axially in the upward direction. More particularly, in order to use the liquid applicator, the cap is first removed from the container and the jacket is rotated about the mouth portion to bring the liquid applicator to the open position. As the jacket is rotated, it moves in an upward direction, the upward biasing force of the biasing member pushes the flow control unit in the upward direction to open the apertures in the bottom wall of the plug.

In alternate embodiment of the present invention, the collar holder may be made in a single piece with rotatable jacket and can be used as an actuation means.

In embodiments of the present invention, the actuation means is rotatable and axially displaceable along the longitudinal axis of the liquid applicator, however it is within ambient of the present invention that the actuation means may be axially displaceable along the longitudinal axis of the liquid applicator but may not be rotatable.

These and further aspects which will be apparent to the expert of the art are attained by the liquid applicator in accordance with the main claim.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1A:
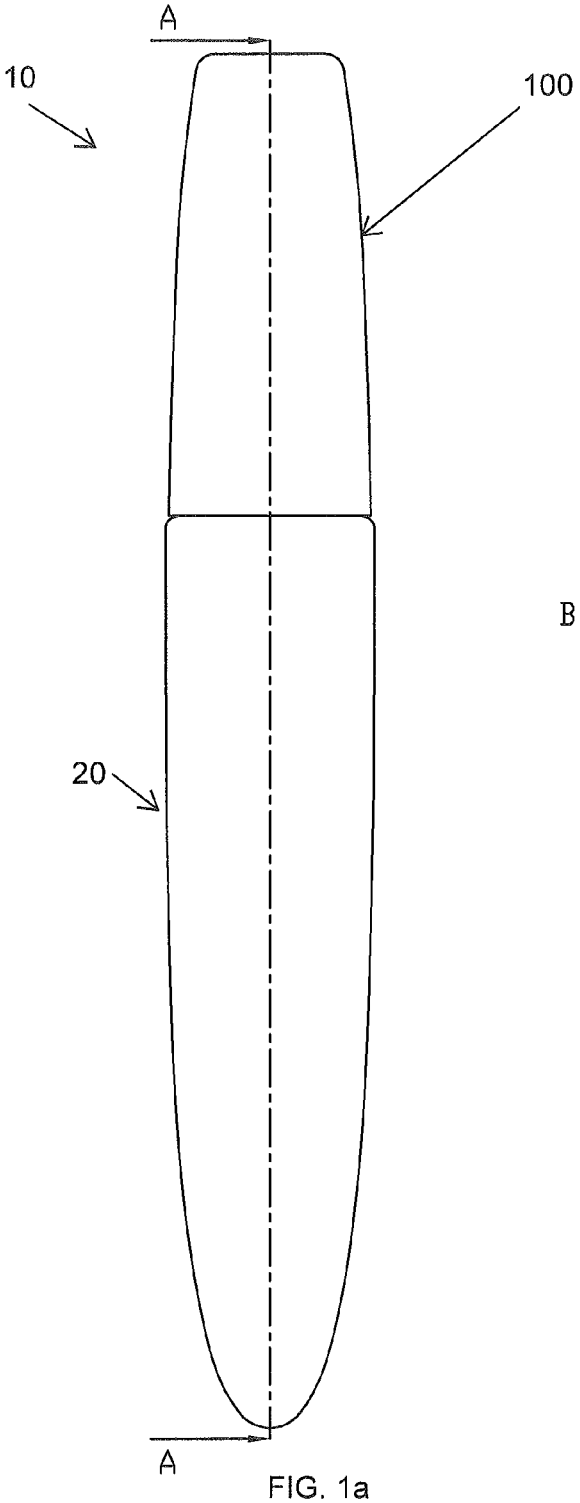
FIG. 1*a* illustrates a front view of a liquid applicator in closed position according to one embodiment of the invention.

To facilitate understanding, identical reference numerals have been used, where possible, to designate identical elements that are common to the figures. It is to be noted, however, that the appended drawings illustrate only typical embodiments of this invention and are therefore not to be considered limiting of its scope, for the invention may admit to other equally effective embodiments.

DETAILED DESCRIPTION

Figure 1B:
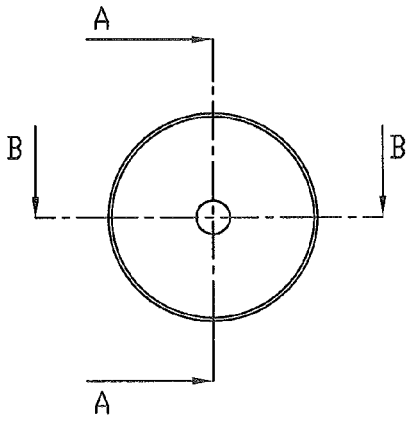
FIG. 1*b* illustrates a top view of the liquid applicator of FIG. 1*a;*
Figure 1C:
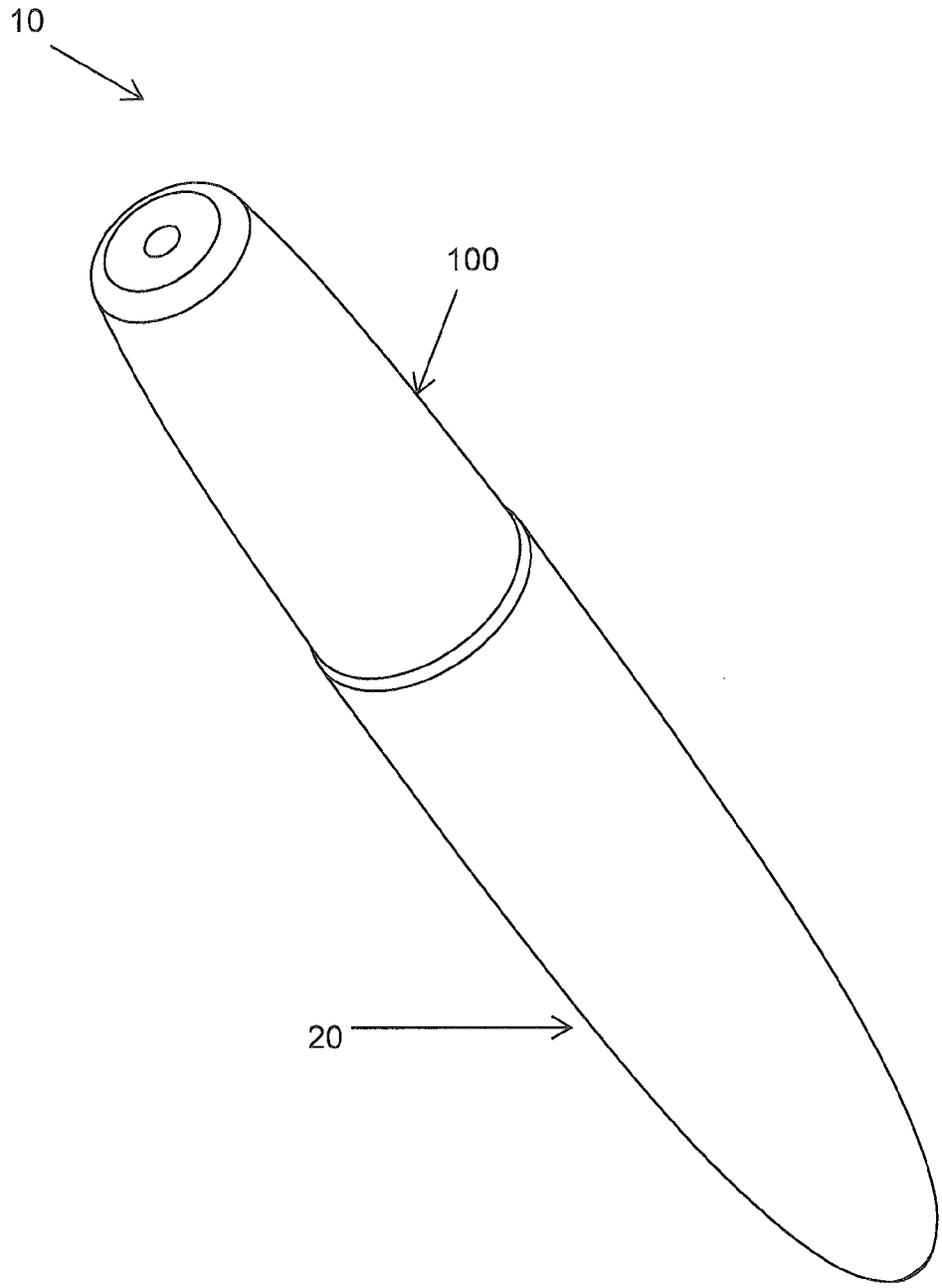
FIG. 1*c* illustrates a perspective view of the liquid applicator of FIG. 1*a;*
Figure 2:
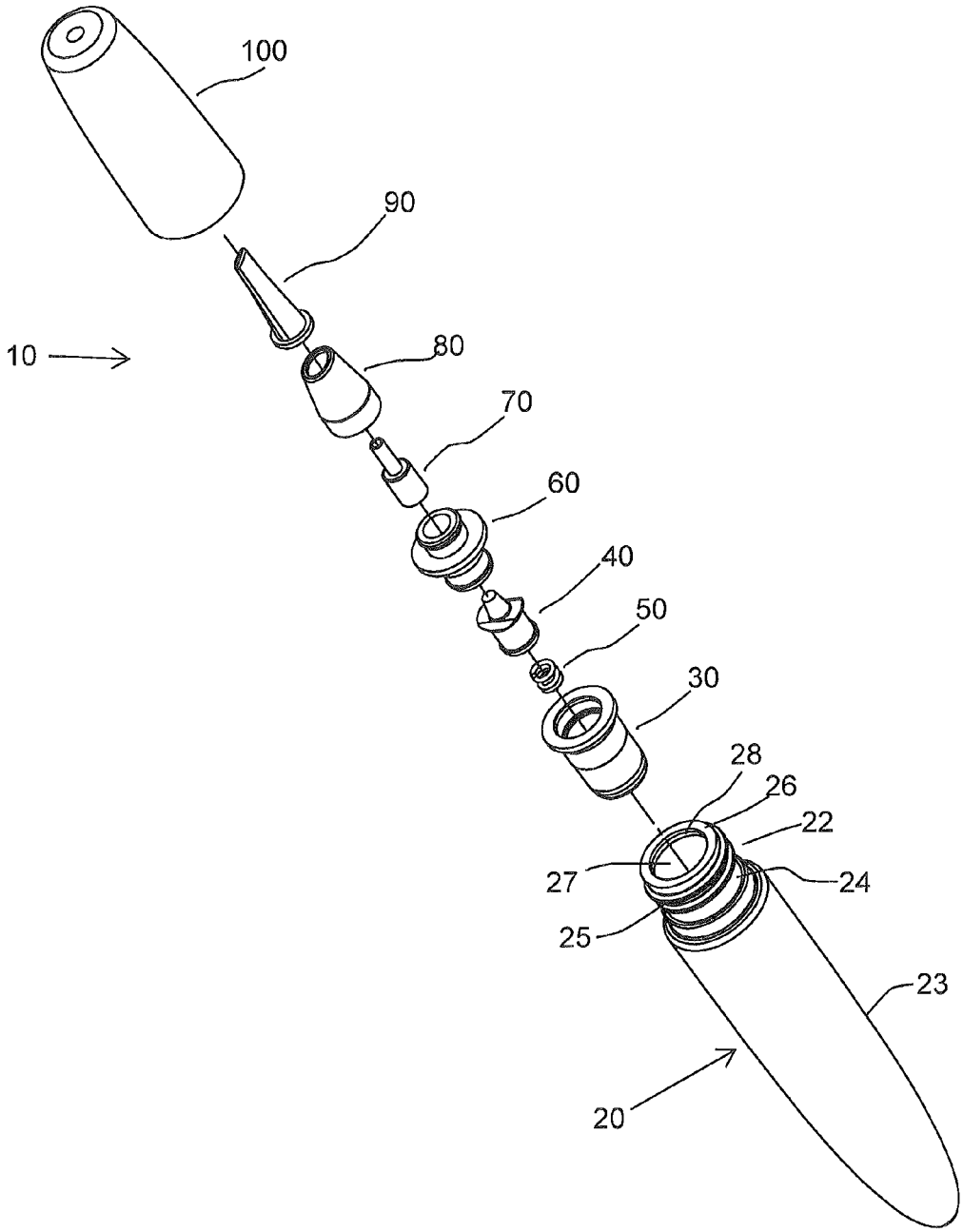
FIG. 2 illustrates an exploded perspective view of the liquid applicator of FIG. 1*a;*

FIG. 1*a* to 2 shows a liquid applicator 10 according one embodiment of the present invention. FIG. 1*a* and FIG. 1*b* show a front view and a top view of the liquid applicator 10 in a closed position. FIG. 1*c* shows a perspective view of the liquid applicator 10.

Figure 6A:
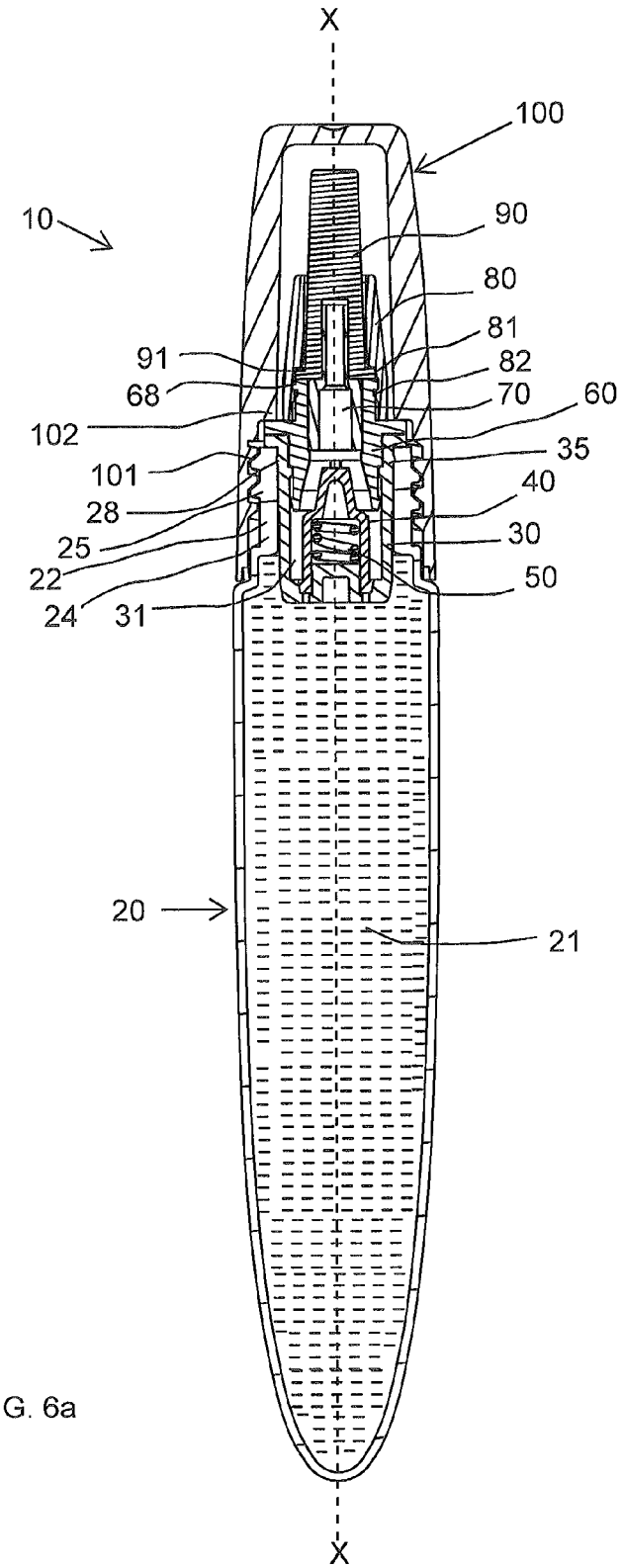
FIG. 6*a* illustrates a longitudinal-sectional view along axis A-A of the liquid applicator of FIG. 1*a;*
Figure 6B:
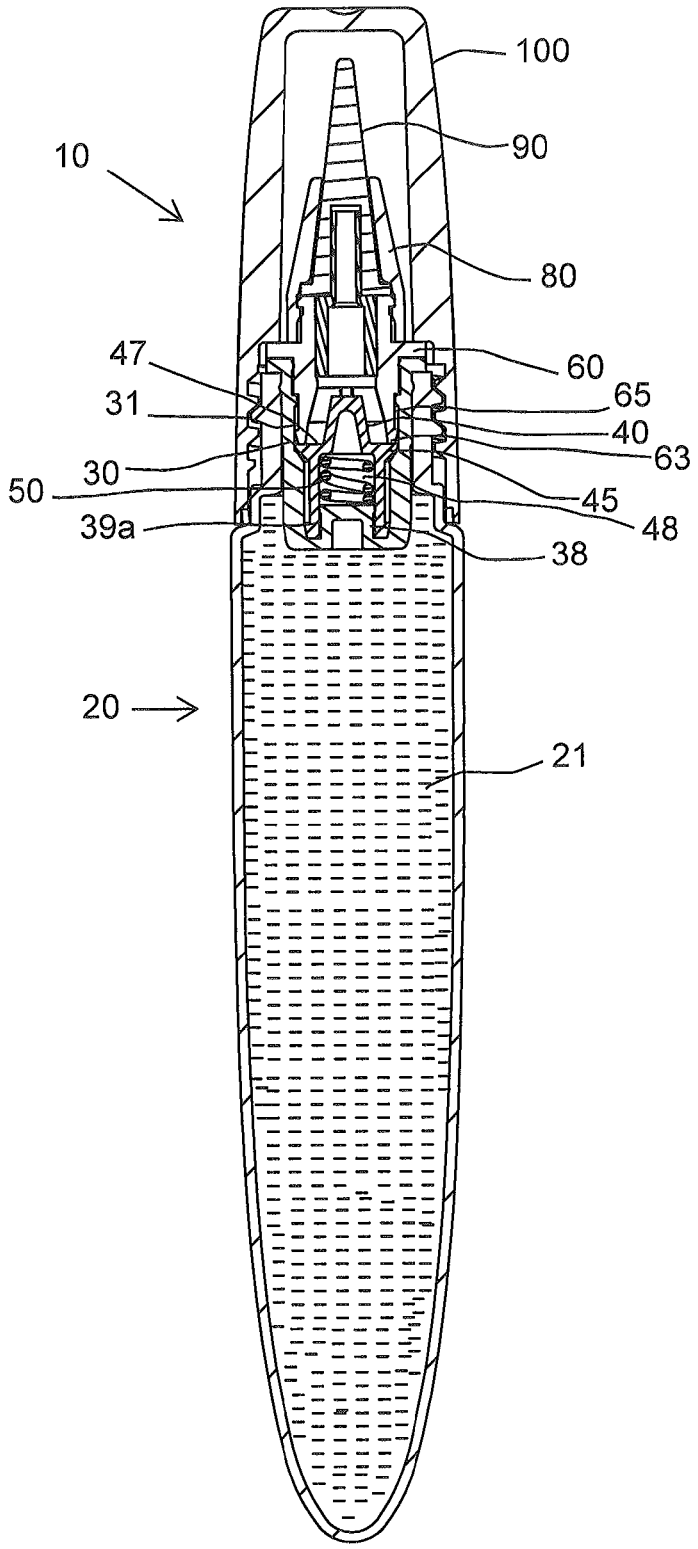
FIG. 6*b* illustrates a longitudinal-sectional view along axis B-B of the liquid applicator of FIG. 1*a;*
Figure 6C:
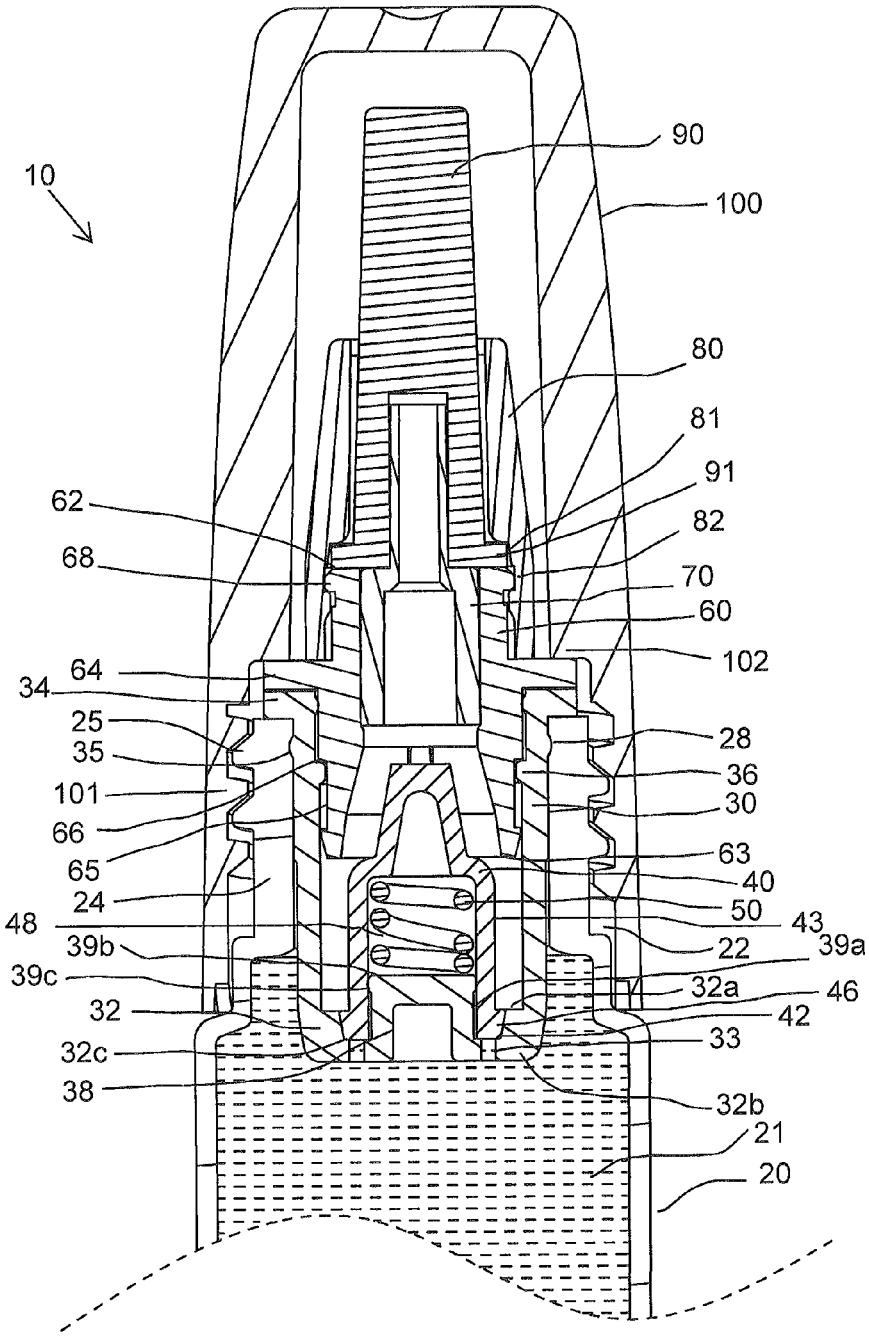
FIG. 6*c* illustrates an enlarged view of a portion of the liquid applicator of FIG. 6*a;*
Figure 6D:
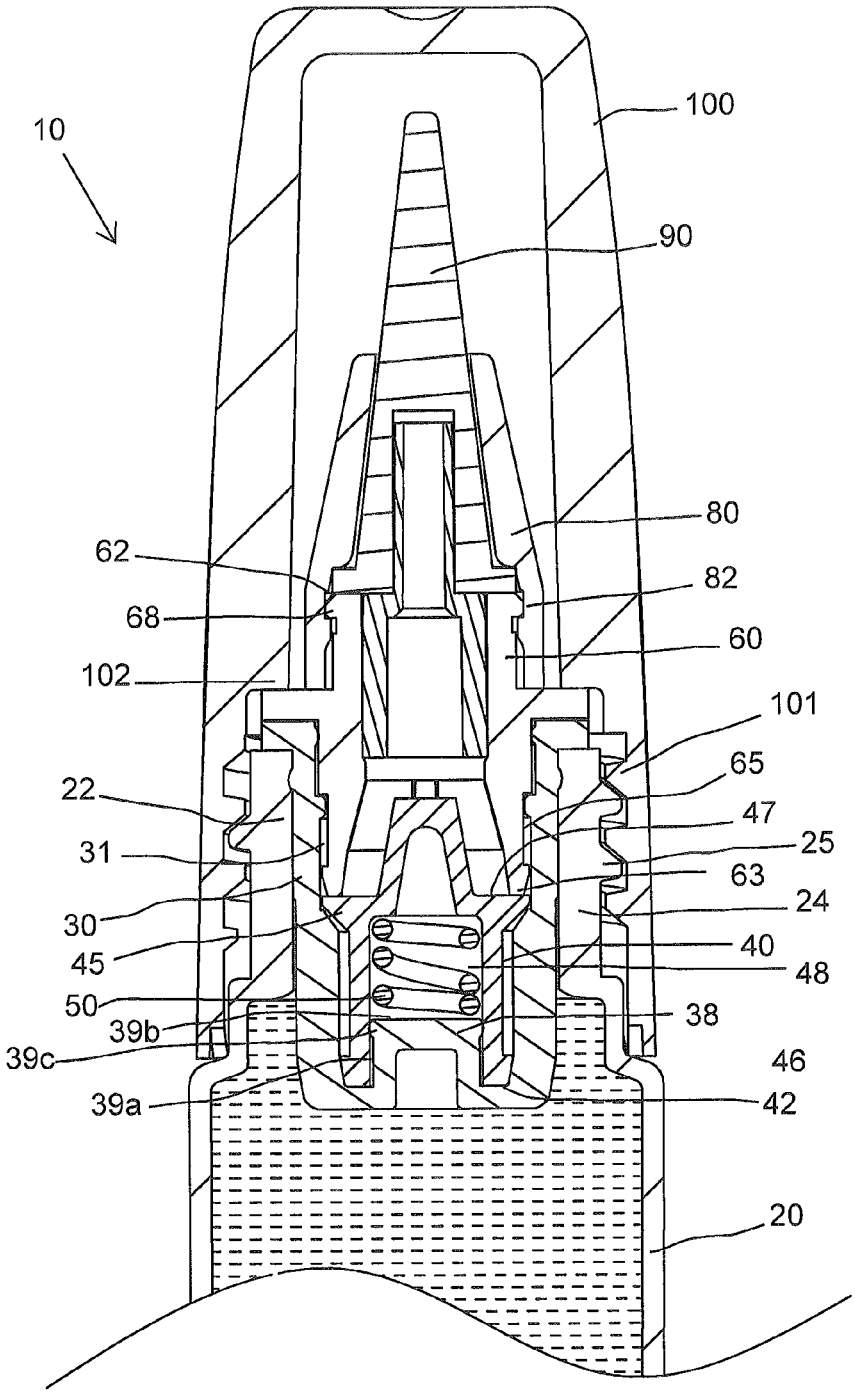
FIG. 6*d* illustrates an enlarged view of a portion of the liquid applicator of FIG. 6*b;*

As represented in FIGS. 1*a* to 2, the liquid applicator 10 has a container 20 which stores therein, as liquid content 21 (as shown in FIG. 6*a*), cosmetics such as lip cream, lip color, chemicals or the like, and is used as a tool for application of cosmetics, chemicals or the like, and incorporates, in addition to the container 20, a plug 30, a flow control unit 40, a biasing member 50, a collar holder 60, a discharge barrel 70, a collar 80, an application member 90 and an actuation means in form of a cap 100 which will be explained later.

The container 20 is a tube container having a mouth portion 22 and a main body 23 which can be deformed by being pressed. According to another embodiment of the invention, the container 20 can be any other container with a main body 23 which cannot be deformed by being pressed. The mouth portion 22 comprises a barrel part 24 having threads 25 formed on its outer side, a rim 26 and an opening 27 in its central part. The barrel part 24 further comprises an annular groove 28 on its inner side.

Figure 3A:
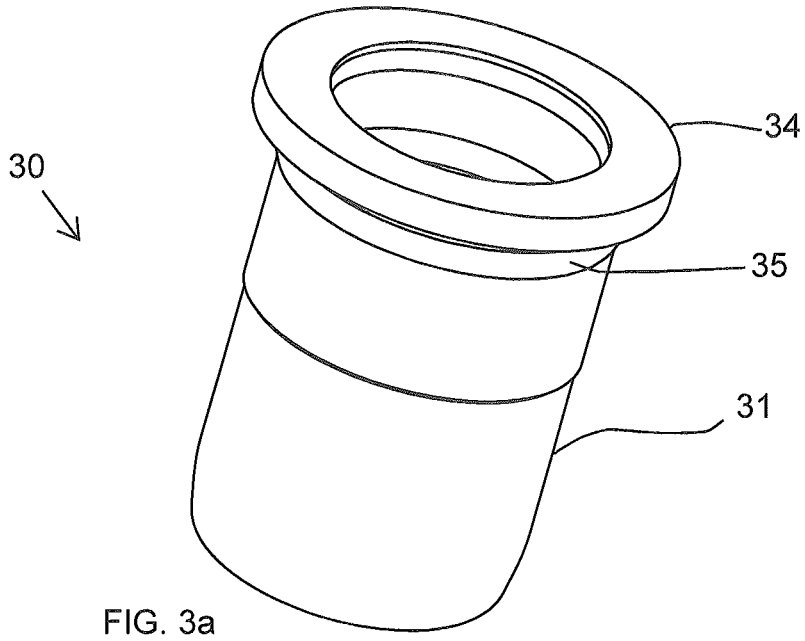
FIG. 3*a* illustrates a perspective view of a plug of the liquid applicator of FIG. 1*a;*
Figure 3B:
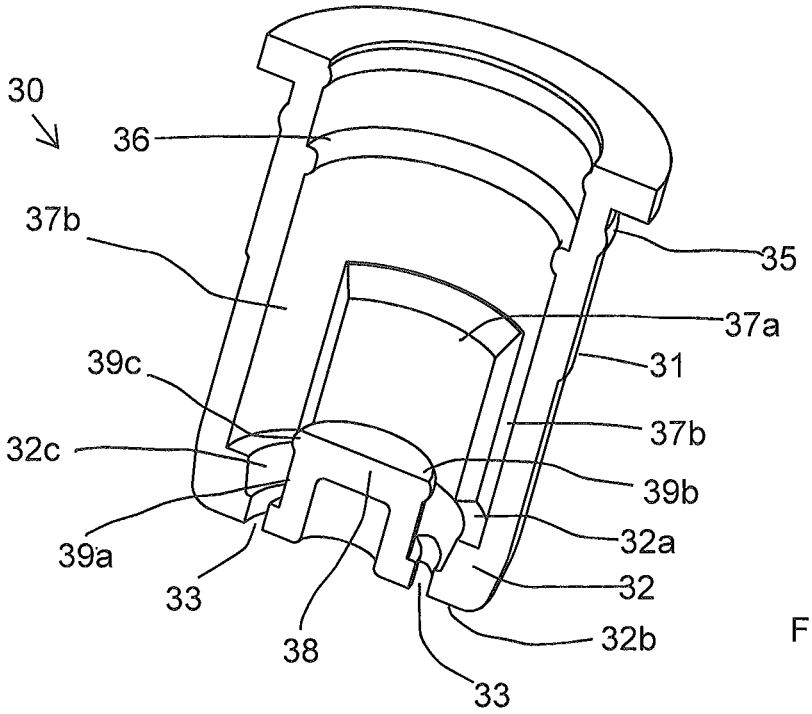
FIG. 3*b* illustrates a longitudinal-sectional view of the plug of FIG. 3*a;*
Figure 4C:
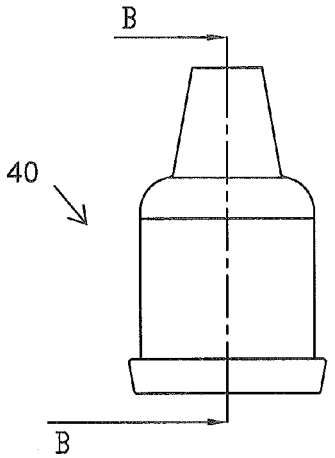
FIG. 4*c* illustrates a side view of the flow control unit of FIG. 4*a;*
Figure 4D:
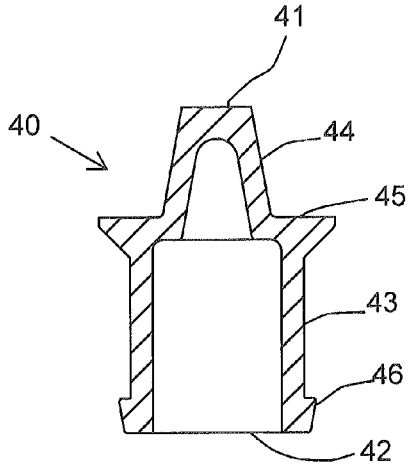
FIG. 4*d* illustrates a longitudinal-sectional view along axis A-A of the flow control unit of FIG. 4*b;*
Figure 4B:
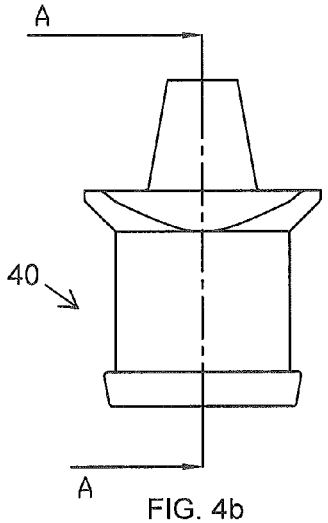
FIG. 4*b* illustrates a front view of the flow control unit of FIG. 4*a;*
Figure 4E:
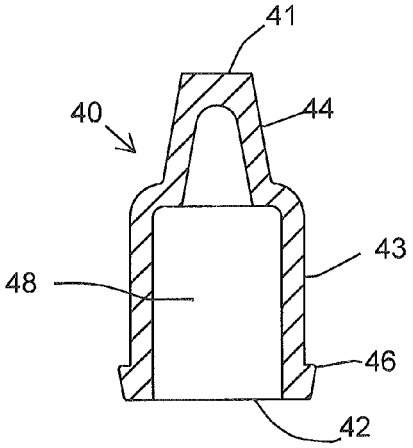
FIG. 4*e* illustrates a longitudinal-sectional view along axis B-B of the flow control unit of FIG. 4*c;*
Figure 4A:
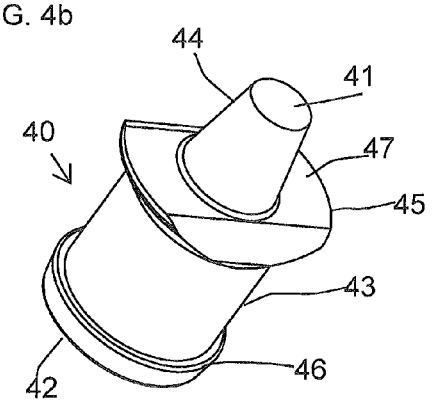
FIG. 4*a* illustrates a perspective view of a flow control unit of the liquid applicator of FIG. 1*a;*

As shown in FIGS. 3*a* and 3*b*, the plug 30 is generally cylindrical in shape and comprises a peripheral wall 31 defining a hollow space; a bottom wall 32 with at least one aperture 33 and a radially extended circular rim 34. According to a preferred embodiment and as shown in FIGS. 3*a* and 3*b*, the bottom wall 32 has two apertures 33. According to a more preferred embodiment the bottom wall 32 has a top surface 32*a* and a bottom surface 32*b* wherein the bottom surface 32*b* has two apertures 33. Further, the bottom surface 32*b* has a raised cylindrical post 38 having an annular groove 39*a*, a top surface 39*b* and a radially extended circular rim 39*c*. The bottom wall 32 further has an annular furrow 32*c*. The peripheral wall 31 has an annular projection 35 on its outer side and an annular projection 36 on its inner side. According to another embodiment, the peripheral wall 31 has at least one inwardly projected wall surface 37*a* on its inner side, wherein the inwardly projected wall surface 37*a* touches the top surface 32*a* of the bottom wall 32. According to a preferred embodiment, the peripheral wall 31 has two diametrically opposite inwardly projected wall surfaces 37*a* on its inner side, wherein the two diametrically opposite inwardly projected wall surfaces 37*a* touch the top surface 32*a* of the bottom wall 32. The at least one inwardly projected wall surface 37*a* results in the formation of a longitudinal furrow 37*b* providing a path for the flow of the liquid content 21 through the apertures 33. Preferably, the two diametrically opposite inwardly projected wall surfaces 37*a* results in the formation of two longitudinal furrows 37*b* on the inner side of the peripheral wall 31, providing a path for the flow of the liquid content 21 through the apertures 33, although a small amount of the liquid content can also flow along the inwardly projected wall surfaces 37*a*.

As shown in FIGS. 4*a* to 4*e*, the flow control unit 40 comprises of a cavity 48 formed by a hollow body having a top end 41 and a bottom end 42. The flow control unit 40 further comprises of a cylindrical wall portion 43, conically tapered wall portion 44 which tapers towards the top end 41, at least two flange discs 45 on the cylindrical wall portion 43 and an annular projection 46 at the bottom end 42. The at least two flange discs 45 are present on the cylindrical wall portion 43 and below the tapered wall portion 44. Each of the two flange discs 45 comprises a flat surface 47 such that the flat surfaces 47 do not completely circumscribe the cylindrical wall portion 43 of the flow control unit 40.

Figure 5A:
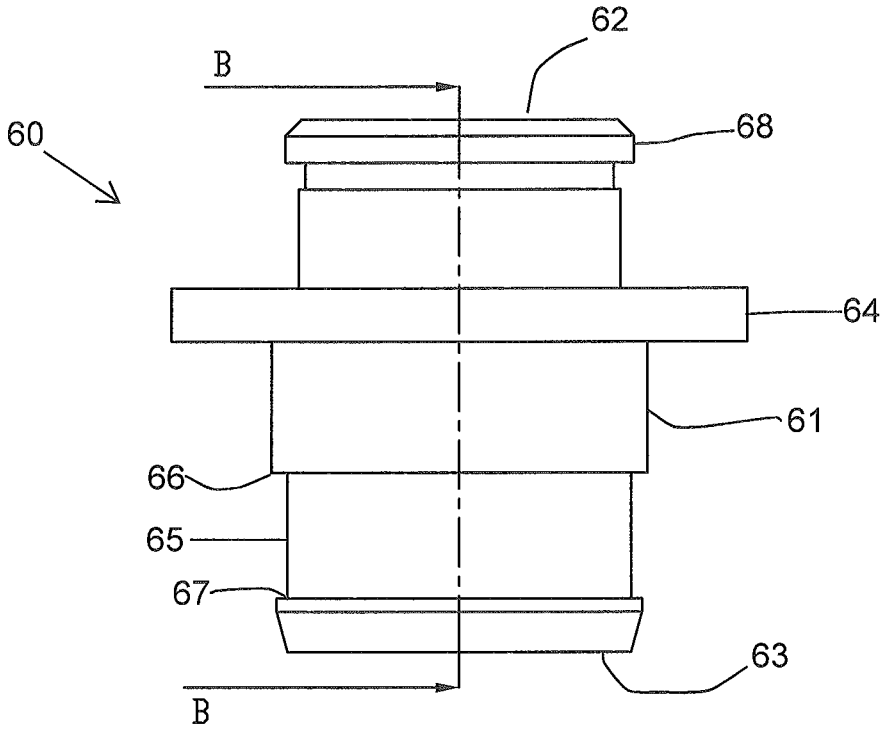
FIG. 5*a* illustrates a front view of a collar holder of the liquid applicator of FIG. 1*a;*
Figure 5B:
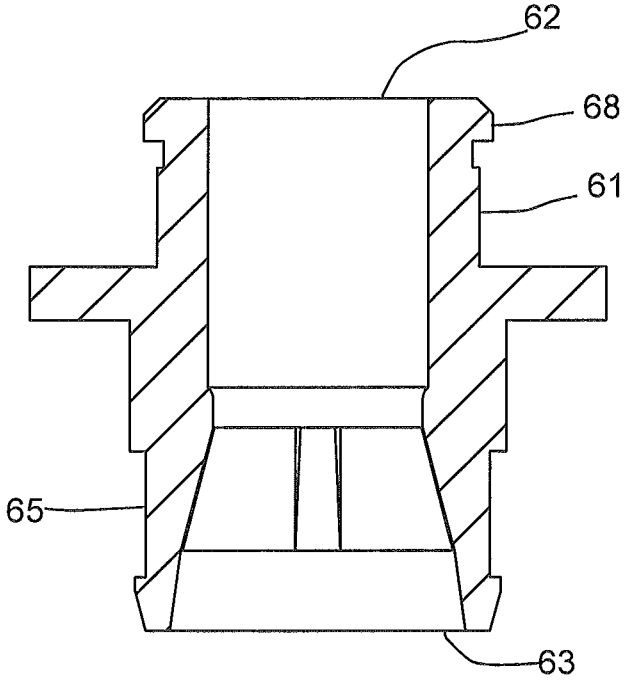
FIG. 5*b* illustrates a longitudinal-sectional view along axis B-B of the collar holder of FIG. 5*a;*

As shown in FIGS. 5*a* and 5*b*, the collar holder 60 comprises of a hollow cylindrical body 61 having an open top end 62 and an open bottom end 63. The hollow cylindrical body 61 comprises on its outer side, an annular flange 64 at an appropriate position and an annular groove 65. The annular groove 65 has a top end 66 and a bottom end 67 and is extended in a longitudinal direction up to a predetermined length.

The assembly of the liquid applicator 10 will be explained hereinafter by referring to FIGS. 2 to 6*d*.

The plug 30 is fitted into the opening 27 of the mouth portion 22 of the container 20. The annular projection 35 on the outer side of the peripheral wall 31 of the plug 30 engages with a corresponding annular groove 28 on the inner side of the barrel part 24 of the mouth portion 22 of the container 20 and the radially extended circular rim 34 of the plug 30 rests on a circular rim 26 of the mouth portion 22 of the container 20. The plug 30 can also be fitted in the mouth portion 22 of the container 20 by any other suitable attachment means. The suitable attachment means includes a hinge, a pin, a snap, a hook, a j-lock, a threaded engagement or the like.

The flow control unit 40 is arranged to be moved inside the hollow space of the plug 30 along the longitudinal axis X-X of the liquid applicator 10. As specifically shown in FIGS. 6*b* and 6*d*, each of the two diametrically opposite flange discs 45 of the flow control unit 40 is in close proximity to the inner side of the peripheral wall 31 of the plug 30. The annular groove 39*a* of the post 38 provides a guide path for the movement of the flow control unit 40 inside the plug 30.

The biasing member 50 is arranged inside the cavity 48 and is enclosed within the cylindrical wall portion 43 of the flow control unit 40 and further rests against a top surface 39*b* of the post 38 on the bottom wall 32 of the plug 30. The biasing member 50 provides an upward moving force to the flow control unit 40. Further, the biasing member 50 can be a made up of any metal, alloy or thermoplastic polymer providing resilient properties to the biasing member 50.

The collar holder 60 is arranged to be moved inside the hollow space of the plug 30 along the longitudinal axis X-X of the liquid applicator 10, such that the collar holder 60 is partially inside the plug 30 and partially outside the plug 30. The collar holder 60 is capable of moving in an upward direction and a downward direction in a predetermined interval depending upon the length of the annular groove 65. As specifically shown in FIGS. 6*b* and 6*d*, the bottom end 63 of the collar holder 60 abuts on the flat surface 47 of each of the two flange discs 45 of the flow control unit 40.

The application member 90 is attached to the collar 80. The application member 90 comprises an annular projection 91 at its bottom end which fits into a corresponding annular groove 81 of the collar 80. The application member 90 can also be attached to the collar 80 by any other suitable attachment means. The suitable attachment means includes a hinge, a pin, a snap, a hook, a j-lock, a threaded engagement or the like.

The collar 80 is attached to the collar holder 60. The collar 80 comprises an annular groove 82 near its bottom end which fits into a corresponding annular projection 68 at a top end 62 of the collar holder 60. The collar can be attached to the collar holder by any other suitable attachment means. The suitable attachment means includes a hinge, a pin, a snap, a hook, a j-lock, a threaded engagement or the like.

The discharge barrel 70 is attached inside the collar holder 60 by suitable attachment means. The suitable attachment means includes a hinge, a pin, a snap, a hook, a j-lock, a threaded engagement or the like.

The cap 100 comprises threads 101 on its inner side and a sealing flange 102 above the threads 101. The cap 100 is removably connected to the mouth portion 22 of the container 20 to bring the liquid applicator 10 to a closed position and to an open position. The cap 100 can be screwed on the threads 25 of the barrel part 24 of the mouth portion 22 of the container 20. The cap 100 can be attached to the container 20 by suitable attachment means. The suitable attachment means includes a hinge, a pin, a snap, a hook, a j-lock or the like.

As shown in FIGS. 6*a* to 6*d*, when the liquid applicator 10 is not in use, the cap 100 is displaced axially in downward direction to close the liquid applicator 10. Preferably and as shown in the present embodiment, in order to displace the cap 100 axially in downward direction the cap 100 is screwed on by engaging the threads 101 of the cap 100 with the threads 25 of the barrel part 24 of the mouth portion 22 of the container 20 to close the liquid applicator 10. As the cap 100 is screwed on, to bring the liquid applicator 10 in a closed position, the sealing flange 102 of the cap 100 presses the annular flange 64 of the collar holder 60 so that the collar holder 60 moves in a downward direction. Since the bottom end 63 of the collar holder 60 abuts on the flat surface 47 of each of the two flange discs 45 of the flow control unit 40, the collar holder 60 pushes the flow control unit 40 in a downward direction to close the apertures 33 in the bottom wall 32 of the plug 30. Preferably, the annular projection 46 at the bottom end 42 of the flow control unit 40 closes the apertures 33 in the bottom wall 32 of the plug 30. The annular projection 46 of the flow control unit 40 sits in the annular furrow 32*c* in the bottom wall 32 of the plug 30 to close the apertures 33 in the bottom surface 32*b* of the bottom wall 32 of the plug 30. In the closed position, the annular flange 64 at the predetermined position of the collar holder 60 rests on the radially extended circular rim 34 of the plug 30 and the top end 66 of the annular groove 65 abuts against the annular projection 36 of the plug 30. In the closed position of the liquid applicator, the apertures 33 in the bottom wall 32 of the plug 30 are completely blocked by the flow control unit 40 and no liquid content 21 flows from the apertures 33 even when the main body 23 is under certain pressure.

Figure 7A:
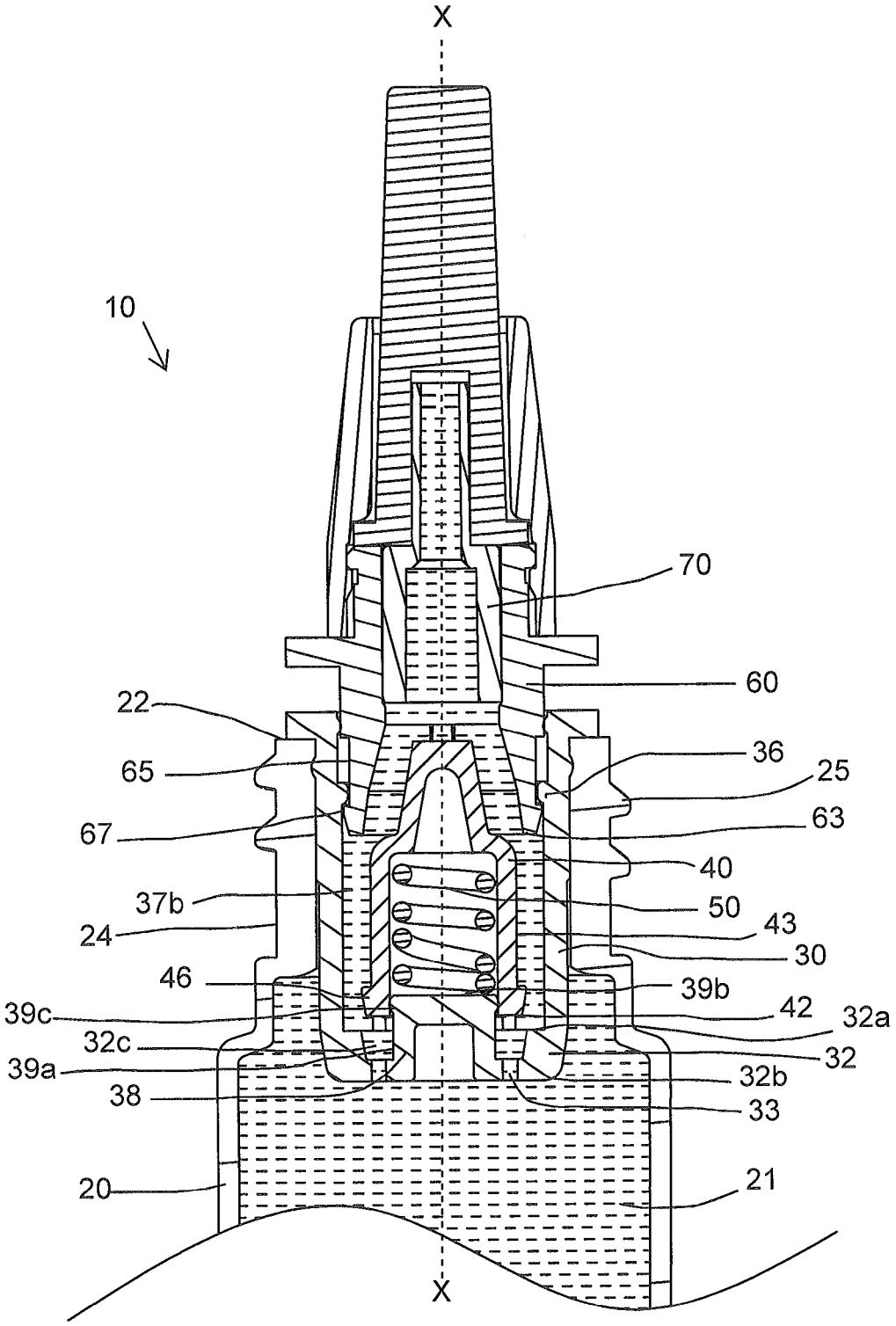
FIG. 7*a* illustrates an open position of the liquid applicator of FIG. 6*c;*
Figure 7B:
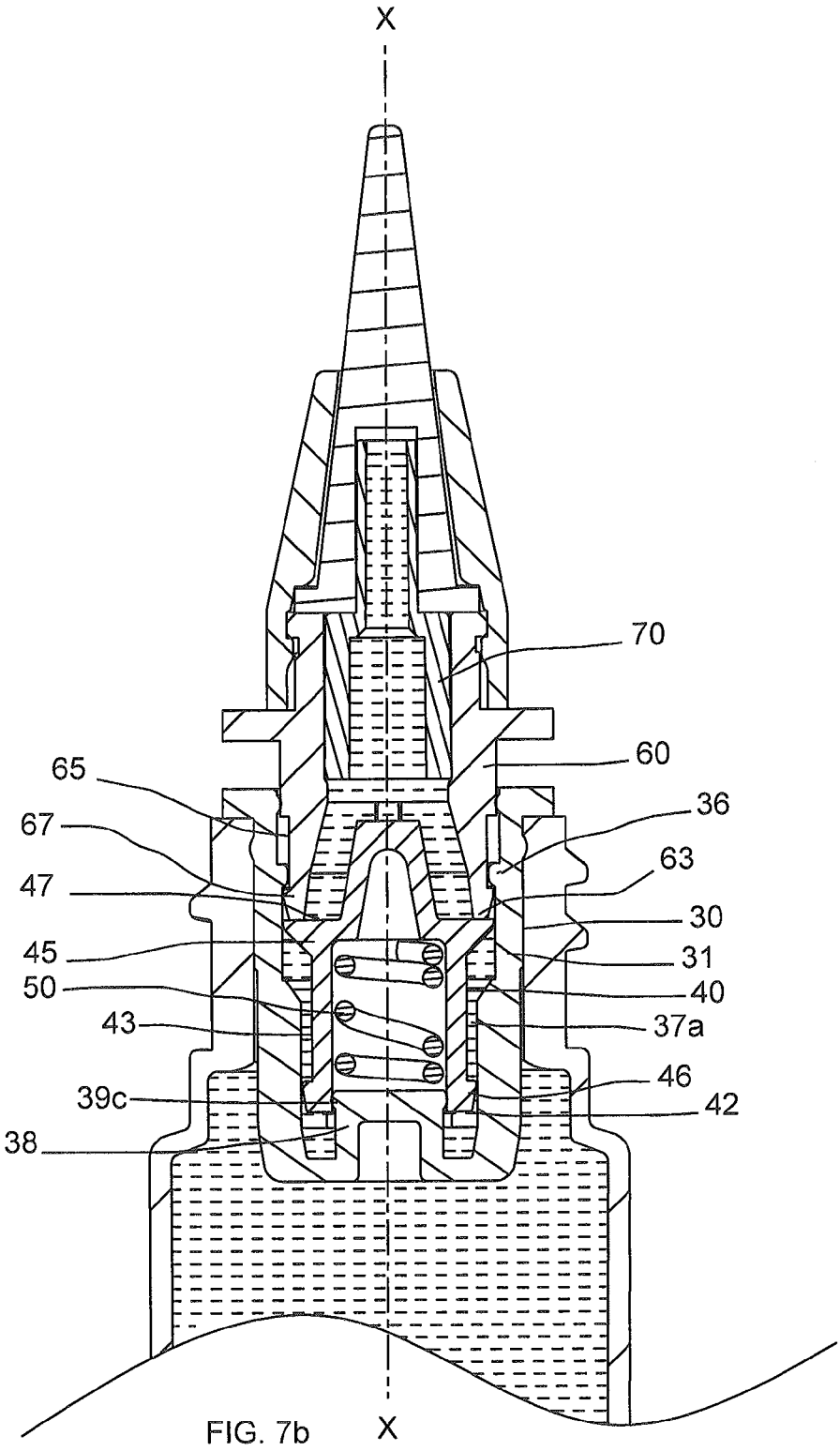
FIG. 7*b* illustrates an open position of the liquid applicator of FIG. 6*d;*

As shown in FIGS. 7*a* and 7*b*, in order to use the liquid applicator 10, the cap 100 is displaced axially in upward direction to open the liquid applicator 10. Preferably and as shown in the present embodiment, in order to displace the cap 100 axially in upward direction the cap 100 is screwed off by disengaging the threads 101 of the cap 100 with the threads 25 of the barrel part 24 of the mouth portion 22 of the container 20 to bring the liquid applicator 10 to an open position. As the cap 100 is screwed off, the biasing force of the biasing member 50 pushes the flow control unit 40 in an upward direction to open the apertures 33 in the bottom wall 32 of the plug 30. Preferably, the annular projection 46 of the flow control unit 40 moves out of the annular furrow 32*c* in the bottom wall 32 of the plug 30 to open the apertures 33 in the bottom surface 32*b* of the bottom wall 32 of the plug 30. Since the bottom end 63 of the collar holder 60 abuts on the flat surface 47 of each of the two flange discs 45 of the flow control unit 40, the flow control unit 40 pushes the collar holder 60 so that the collar holder 60 moves in an upward direction. During movement of the flow control unit 40 inside the plug 30, the annular projection 46 at the bottom end 42 of the flow control unit 40 is in close proximity to the two diametrically opposite inwardly projected wall surfaces 37*a* on the inner side of the peripheral wall 31 of the plug 30 to prevent any translational movement of the flow control unit 40 inside the plug 30 and further keeps the flow control unit aligned along the longitudinal axis X-X of the liquid applicator 10. The translational movement is the movement perpendicular to the longitudinal axis X-X of the liquid applicator 10. In the open position, the bottom end 67 of the annular groove 65 of the collar holder 60 abuts against the annular projection 36 of the plug 30 and the inner side at the bottom end 42 of the peripheral wall of the cylindrical portion 43 of the flow control unit 40 abuts against the radially extended circular rim 39*c* of the post 38 of the plug 30. In the open position of the liquid applicator, the apertures 33 in the bottom wall 32 of the plug 30 are completely opened by the flow control unit 40 and the liquid content 21 flows from the apertures 33 to the discharge barrel 70. The liquid content 21 flows from the apertures 33 to the discharge barrel 70 so that the container 20, plug 30, collar holder 60 and the discharge barrel 70 are in fluid communication with each other. Preferably, the liquid content 21 flows from the apertures 33 to the furrow 32*c* and longitudinal furrows 37*b* of the plug 30, then to the collar holder 60 and finally to the discharge barrel 70. The liquid content 21 flows from the plug 30 to the collar holder 60 following a path where the bottom end 63 of the collar holder 60 does not abut the cylindrical portion 43 of the flow control unit 40. A small volume of the liquid content will flow along the inwardly projected walls 37*a*. No liquid content 21 enters into the flow control unit 40 and the biasing member 50 disposed inside the flow control unit 40 does not come into contact with the liquid contents 21. Thus, the liquid applicator 10 prevents the liquid contents 21 from getting contaminated and also prevents wear of the biasing member 50, extending the life of the biasing member 50. Further, in the open position, when the main body 23 is squeezed to force the liquid content 21 out, no squeezed contents will backflow even when the pressure is reduced or stopped. Thus, the liquid applicator 10 can not only be used conveniently but can isolate air pollution and, thus, has advantage in usage.

Figure 8A:
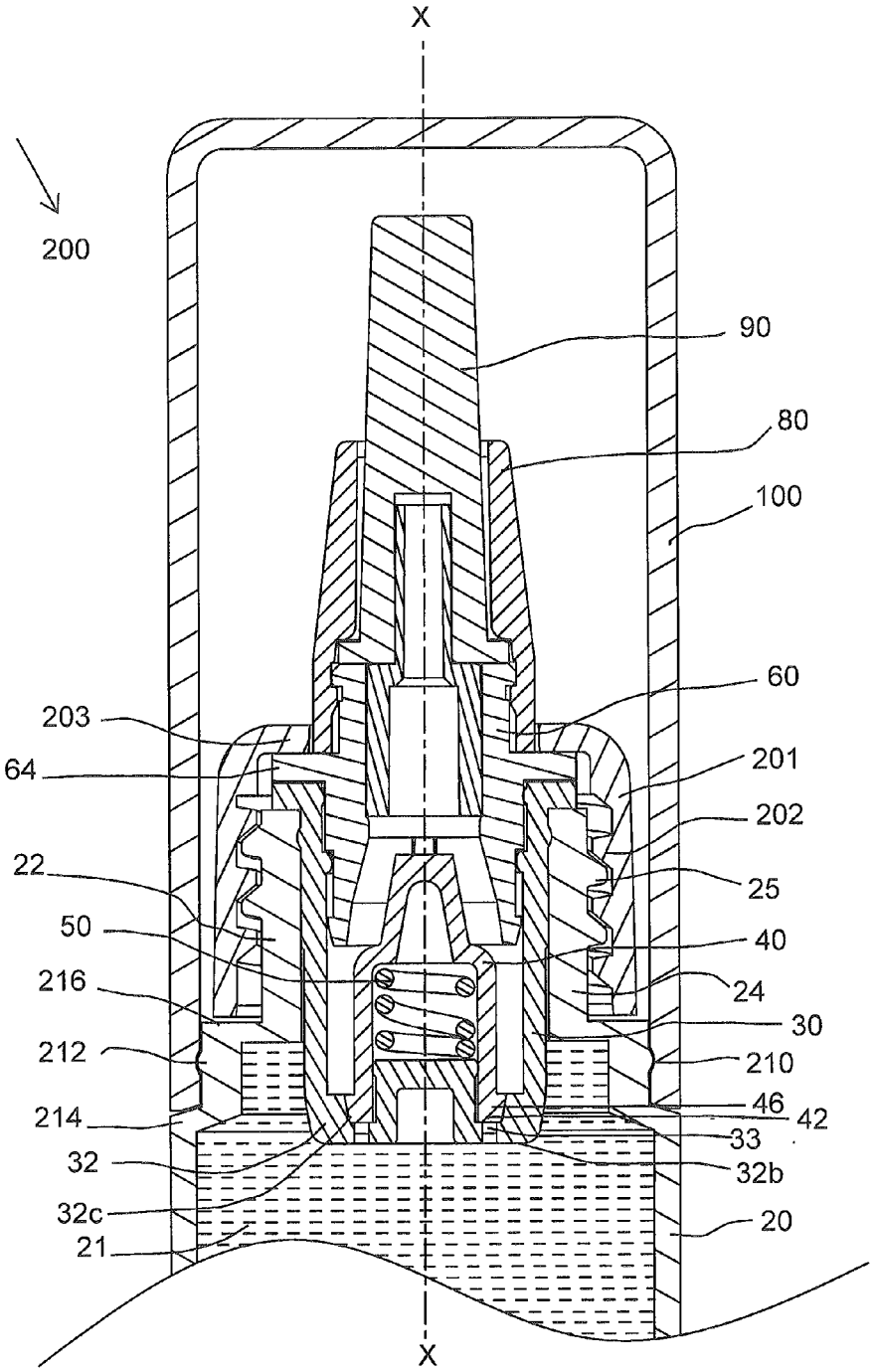
FIG. 8*a* illustrates a cross-sectional view of a portion of a liquid applicator according to a second embodiment of the present invention.

FIG. 8*a* illustrates a liquid applicator 200 according to a second embodiment of the present invention. The liquid applicator 200 is substantially similar to the liquid applicator 10 described above, except that, the liquid applicator 200 comprises a jacket 201 attached to a portion of the container 20, and wherein closing and opening of the liquid applicator 200 is actuated by the jacket 201 and not by the cap 100. The cap 100 is removably attached to the container 20 so that the application member 90 attached to the collar 80 is housed and protected within the cap 100 when not in use. The cap 100 is snap-fitted onto the container 20 in order to close the container 20; however, the cap 100 can be attached to the container 20 by suitable attachment means. The suitable attachment means includes a hinge, a pin, a hook, a j-lock, a threaded engagement, an interference engagement or the like. According to present embodiment, the cap 100 includes an annular groove 210 for snap-fit engagement with a complimentary annular projection 212 located on the outer surface of the container 20 between a first shoulder 214 and a second shoulder 216 of the container 20.

The jacket 201 is rotatably attached to the mouth portion 22 of the container 20 by means of internal threads 202 that are designed to mate with threads 25 of the barrel part 24 of the mouth portion 22. The jacket 201 is configured to rotate and axially displaced about the barrel part 24 of the mouth portion 22 between a closed position and an open position of the liquid applicator 200. Further, the collar holder 60 is displaceable in an axial direction along the longitudinal axis X-X with respect to the mouth portion 22 of the container 20 by rotating the jacket 201.

As seen in FIG. 8*a*, in order to bring the liquid applicator 200 to a closed position, the jacket 201 is displaced axially in downward direction. Preferably and as seen in FIG. 8*a*, the jacket 201 is screwed on the mouth portion 22 of the container 20 such that the annular flange 64 of collar holder 60 is pressed in a downward direction by a sealing flange 203 of the rotatable jacket 201. The collar holder 60 which is pressed in downward direction in turn pushes the flow control unit 40 in a downward direction to close the apertures 33 in the bottom wall 32 of the plug 30 and also simultaneously compresses the biasing member 50 disposed inside the cavity 48 of the flow control unit 40. Preferably, the annular projection 46 at the bottom end 42 of the flow control unit 40 closes the apertures 33 in the bottom wall 32 of the plug 30. The annular projection 46 of the flow control unit 40 sits in the annular furrow 32*c* in the bottom wall 32 of the plug 30 to close the apertures 33 in the bottom surface 32*b* of the bottom wall 32 of the plug 30.

Figure 8B:
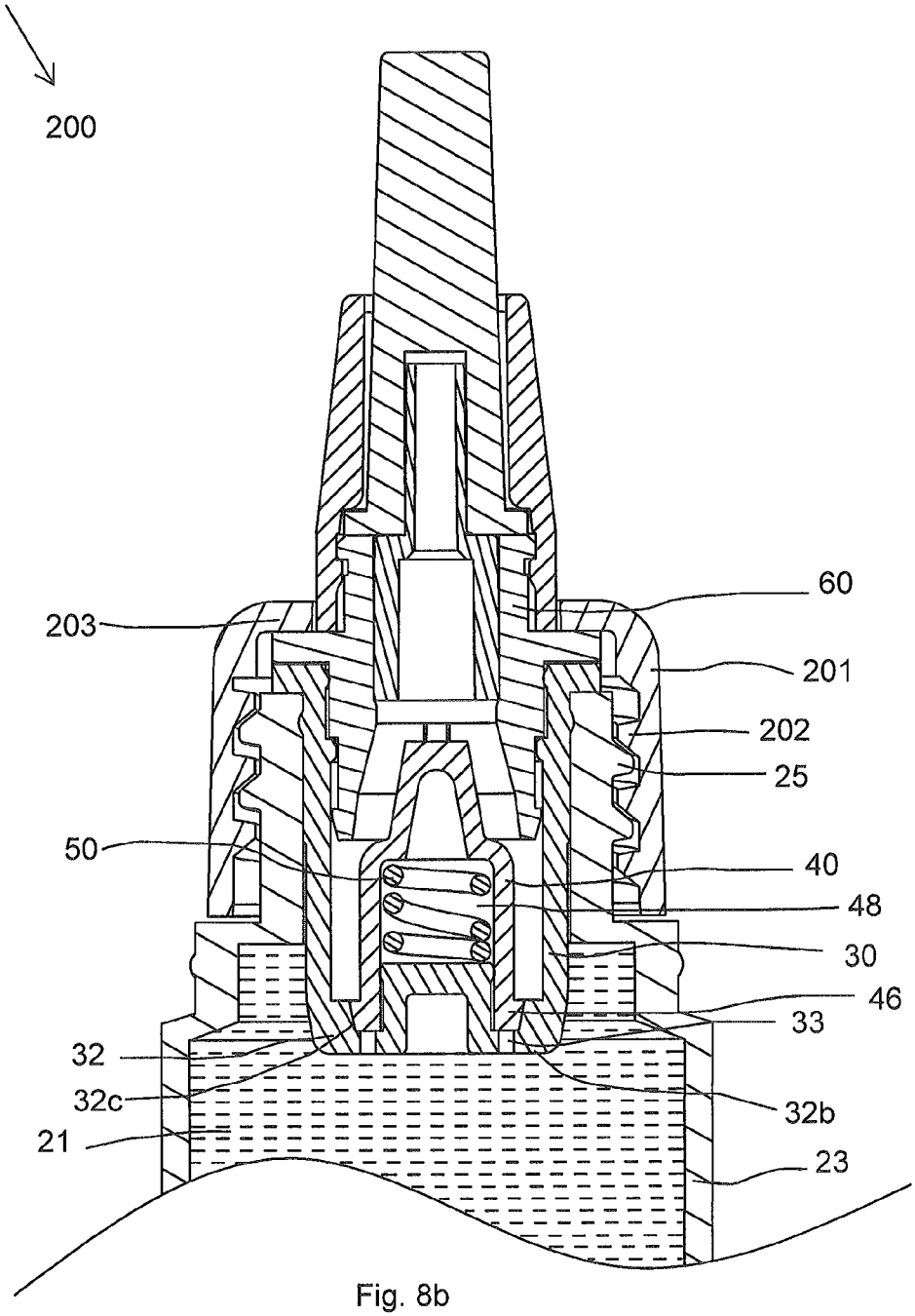
FIG. 8*b* illustrates the liquid applicator of FIG. 8*a* after removal of cap 100.
Figure 8C:
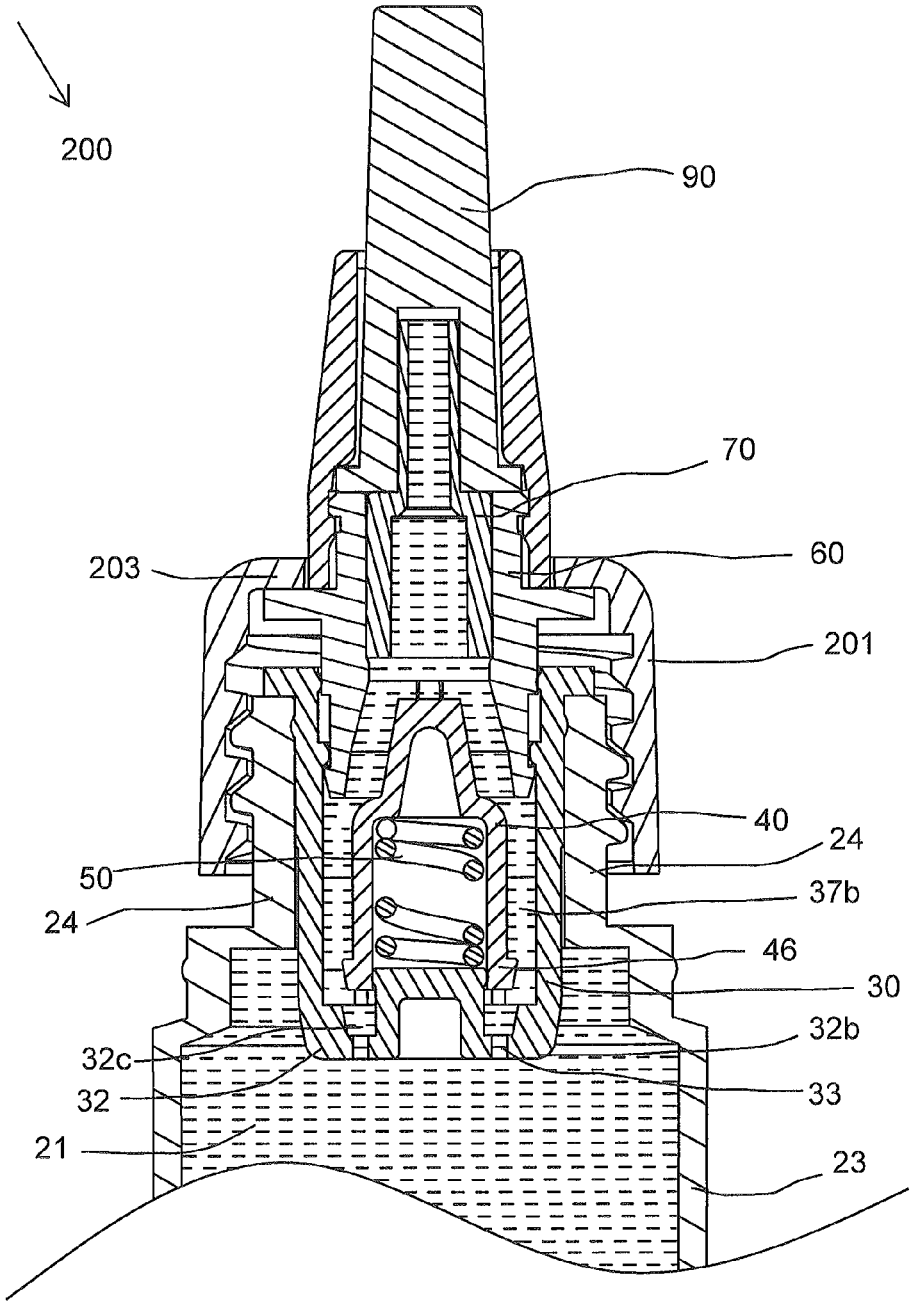
FIG. 8*c* illustrates an open position of the liquid applicator of FIG. 8*a*.

As shown in FIG. 8*b*, in order to use the liquid applicator 200, the cap 100 is removed from the container 20. However, removal of cap 100 does not bring the liquid applicator 200 to an open position and therefore, as seen in FIG. 8*c*, the jacket 201 is displaced axially in upward direction by rotation about the barrel part 24 to bring the liquid applicator 200 to an open position.

As the jacket 201 is rotated it moves in an upward direction which in turn allows the upward biasing force of the biasing member 50 to push the flow control unit 40 in the upward direction to open the apertures 33 in the bottom wall 32 of the plug 30. The annular projection 46 of the flow control unit 40 moves out of the annular furrow 32*c* in the bottom wall 32 of the plug 30 to open the apertures 33 in the bottom surface 32*b* of the bottom wall 32 of the plug 30. The liquid applicator 200 is now in open position, and when the main body 23 of the container 20 is squeezed the liquid content 21 flows through the apertures 33 to the annular furrow 32*c* and longitudinal furrows 37*b* of the plug 30, to the collar holder 60 and finally through to the discharge barrel 70 on to the application member 90.

In an alternate embodiment of the present invention, the collar holder 60 may be made in a single piece with the jacket 201.

In the embodiments as stated above, although the container 20 is in the form of a tube container, it is also possible to use a usual squeeze container or the like, instead of the tube container.

In alternate embodiments of the invention, the container 20 may be made up a material which is non deformable including glass, ceramic, metal, alloy, or the like.

In embodiments of the present invention, the actuation means 100 and 201 are rotatable and axially displaceable along the longitudinal axis X-X of the liquid applicator 10 and 200, however it is within ambient of the present invention that the actuation means 100 and 201 are axially displaceable along the longitudinal axis of the liquid applicator 10, 200 but may not be rotatable.

Furthermore, according to the present invention, the liquid content in the container includes cosmetics such as lip cream or lip color, chemicals or the like which is therefore used as an applicator, though it may be used as an applicator for viscous liquid such as paste, adhesive, paint or the like.

What is claimed is:

1. A liquid applicator comprising:

a container comprising a main body containing a liquid content and a mouth portion;

a plug fitted into an opening of the mouth portion, wherein the plug comprises a peripheral wall defining a hollow space and a bottom wall with at least one aperture;

a flow control unit arranged to be moved inside the hollow space of the plug along a longitudinal axis of the liquid applicator, wherein the flow control unit comprises a cavity;

a biasing member placed inside the cavity of the flow control unit providing an upward biasing force to the flow control unit;

a collar holder arranged to be moved inside the hollow space of the plug along the longitudinal axis of the liquid applicator;

an actuation means attached to the container, the actuation means is configured to displace the collar holder along the longitudinal axis of the liquid applicator to bring the liquid applicator to a closed position and to an open position;

wherein to bring the liquid applicator to the closed position, the actuation means displaces the collar holder and the flow control unit axially in a downward direction along the longitudinal axis counter to the upward biasing force of the biasing member;

wherein to bring the liquid applicator to the open position, the actuation means is displaced axially in an upward direction so that the upward biasing force of the biasing member displaces the collar holder and the flow control unit axially in the upward direction along the longitudinal axis;

wherein, in the closed position, the flow control unit closes the at least one aperture in the plug;

wherein, in the open position, the flow control unit opens the at least one aperture in the plug and the liquid content flows from the container through the at least one aperture to the collar holder such that the container, the plug and the collar holder are in fluid communication with each other; and wherein, in the open position, no liquid content enters into the cavity of the flow control unit.

2. A liquid applicator of claim 1, wherein the actuation means is removably or irremovably coupled to the container.

3. A liquid applicator of claim 1, wherein the actuation means is axially displaceable along the longitudinal axis of the liquid applicator.

4. A liquid applicator of claim 1, wherein the biasing member can be made up of metal, alloy or a thermoplastic polymer capable of providing resilient properties to the biasing member.

5. A liquid applicator of claim 1, wherein the bottom wall of the plug comprises a raised cylindrical post having an annular groove, a top surface and a radially extended circular rim, wherein the annular groove provides a guide path for the movement of the flow control unit.

6. A liquid applicator of claim 5, wherein the peripheral wall of the plug comprises on its inner side, at least one inwardly projected wall surface touching a top surface of the bottom wall of the plug, wherein the at least one inwardly projected wall surface results in the formation of a longitudinal furrow providing a path for the flow of the liquid content there through.

7. A liquid applicator of claim 6, wherein flow control unit comprises of a cylindrical wall portion, a conically tapered wall portion which tapers towards the top end, an annular projection at the bottom end, at least two flange discs on the cylindrical wall portion and wherein each of the two flange discs comprises a flat surface such that the flat surfaces do not completely circumscribe the cylindrical wall portion of the flow control unit.

8. A liquid applicator of claim 7, wherein each of the two flange discs of the flow control unit is in close proximity to the inner side of the peripheral wall of the plug.

9. A liquid applicator of claim 8, wherein the biasing member is enclosed within the cylindrical wall portion of the flow control unit and rests against the top surface of the cylindrical post of the bottom wall of the plug.

10. A liquid applicator of claim 9, wherein the collar holder comprises of a hollow cylindrical body having an open top end and an open bottom end, wherein the bottom end of the collar holder abuts on the flat surface of each of the two flange discs of the flow control unit.

11. A liquid applicator of claim 10, wherein the hollow cylindrical body of the collar holder comprises on its outer side, an annular flange at an appropriate position and an annular groove; wherein the annular groove further has a top end and a bottom end and wherein the annular groove is extended in a longitudinal direction up to a predetermined length.

12. A liquid applicator of claim 11 further comprises a collar attached to the collar holder, an application member attached to the collar, and a discharge barrel attached inside the collar holder for flow of the liquid content to the application member.

13. A liquid applicator of claim 12, wherein the actuation means includes threads on its inner side and a sealing flange above the threads; and wherein the actuation means is threadedly engaged to the mouth portion of the container.

14. A liquid applicator of claim 13, wherein in the closed position of the liquid applicator, the annular projection at the bottom end of the flow control unit sits in an annular furrow in the bottom wall of the plug to close the at least one aperture in a bottom surface of the bottom wall of the plug.

15. A liquid applicator of claim 14, wherein in the closed position of the liquid applicator, the top end of the annular groove of the collar holder abuts against an annular projection on an inner side of the peripheral wall of the plug.

16. A liquid applicator of claim 15 wherein, in the open position of the liquid applicator, the bottom end of the annular groove of the collar holder abuts against the annular projection on the inner side of the peripheral wall of the plug.

17. A liquid applicator of claim 16 wherein, in the open position of the liquid applicator, the inner side at the bottom end of the peripheral wall of the cylindrical portion of the flow control unit abuts against the radially extended circular rim of the post of the plug.

18. A liquid applicator comprising:

a container comprising a main body containing a liquid content and a mouth portion;

a plug fitted into an opening of the mouth portion, wherein the plug comprises a peripheral wall defining a hollow space and a bottom wall with at least one aperture;

a flow control unit arranged to be moved inside the hollow space of the plug along a longitudinal axis of the liquid applicator, wherein the flow control unit comprises a cavity;

a biasing member placed inside the cavity of the flow control unit providing an upward biasing force to the flow control unit;

a collar holder arranged to be moved inside the hollow space of the plug along the longitudinal axis of the liquid applicator;

a cap removably engaged to the mouth portion of the container, the cap is configured to displace the collar holder along the longitudinal axis of the liquid applicator to bring the liquid applicator to a closed position and to an open position;

wherein to bring the liquid applicator to the closed position, the cap is displaced axially in a downward direction to displace the collar holder and the flow control unit axially in the downward direction along the longitudinal axis counter to the upward biasing force of the biasing member;

wherein to bring the liquid applicator to the open position, the cap is displaced axially in the upward direction so that the upward biasing force of the biasing member displaces the collar holder and the flow control unit axially in the upward direction along the longitudinal axis;

wherein, in the closed position, the flow control unit closes the at least one aperture in the plug;

wherein, in the open position, the flow control unit opens the at least one aperture in the plug and the liquid content flows from the container through the at least one aperture to the collar holder such that the container, the plug and the collar holder are in fluid communication with each other; and wherein in the open position of the liquid applicator, the liquid content does not enter into the cavity of the flow control unit.

19. A liquid applicator comprising:

a container comprising a main body containing a liquid content and a mouth portion;

a plug fitted into an opening of the mouth portion, wherein the plug comprises a peripheral wall defining a hollow space and a bottom wall with at least one aperture;

a flow control unit arranged to be moved inside the hollow space of the plug along a longitudinal axis of the liquid applicator, wherein the flow control unit comprises a cavity;

a biasing member placed inside the cavity of the flow control unit providing an upward biasing force to the flow control unit;

a collar holder arranged to be moved inside the hollow space of the plug along the longitudinal axis of the liquid applicator;

a jacket engaged to the mouth portion of the container, the jacket is configured to displace the collar holder along the longitudinal axis of the liquid applicator to bring the liquid applicator to a closed position and to an open position;

wherein to bring the liquid applicator to the closed position, the jacket is displaced axially in a downward direction to displace the collar holder and the flow control unit axially in the downward direction along the longitudinal axis counter to the upward biasing force of the biasing member;

wherein to bring the liquid applicator to the open position, the jacket is displaced axially in an upward direction so that the upward biasing force of the biasing member displaces the collar holder and the flow control unit axially in the upward direction along the longitudinal axis;

wherein, in the closed position, the flow control unit closes the at least one aperture in the plug;

wherein, in the open position, the flow control unit opens the at least one aperture in the plug;

wherein, in the open position, the container, the plug and the collar holder are in fluid communication with each other; and wherein in the open position of the liquid applicator, the liquid content does not enter into the cavity of the flow control unit.

20. A liquid applicator of claim 19, wherein the jacket is made in single piece with the collar holder.

* * * * *